US007222740B2

(12) United States Patent
Garfinkle

(10) Patent No.: US 7,222,740 B2
(45) Date of Patent: May 29, 2007

(54) FREIGHT ENCLOSURE

(75) Inventor: Jeffrey Garfinkle, New York, NY (US)

(73) Assignee: Freight Glove Technologies, LLC, New York, NY (US)

( * ) Notice: Subject to any disclaimer, the term of this patent is extended or adjusted under 35 U.S.C. 154(b) by 518 days.

(21) Appl. No.: 10/648,708

(22) Filed: Aug. 26, 2003

(65) Prior Publication Data

US 2004/0035872 A1 Feb. 26, 2004

Related U.S. Application Data

(63) Continuation-in-part of application No. 10/385,994, filed on Mar. 11, 2003, now abandoned, and a continuation-in-part of application No. 10/112,233, filed on Mar. 28, 2002, now Pat. No. 6,907,712, and a continuation-in-part of application No. 10/266,347, filed on Oct. 8, 2002, now Pat. No. 6,982,643, and a continuation-in-part of application No. 10/300,518, filed on Nov. 20, 2002, now abandoned, and a continuation-in-part of application No. 09/568,113, filed on May 10, 2000, now abandoned.

(51) Int. Cl.
*B65D 88/00* (2006.01)

(52) U.S. Cl. ..... 220/1.5; 220/630

(58) Field of Classification Search ..... 224/42.38, 224/42.39, 42.4; 220/1.5, 4.28, 23.91, 315, 220/322, 617, 630, 635, 729, 751, 754, 759, 220/625; 229/117.25, 125.01, 125.22; 206/386, 206/597; 217/43 A, 66; 150/158, 166, 167
See application file for complete search history.

(56) References Cited

U.S. PATENT DOCUMENTS

| | | | | | |
|---|---|---|---|---|---|
| 1,750,072 | A | * | 3/1930 | Vandivort | 217/12 R |
| 3,414,152 | A | * | 12/1968 | Overton, III | 217/12 R |
| 3,567,068 | A | * | 3/1971 | Carfizzi | 220/630 |
| 3,902,651 | A | * | 9/1975 | Marshall | 229/120 |
| 4,792,026 | A | | 12/1988 | Dimmick et al. | 190/101 |
| 4,919,888 | A | * | 4/1990 | Spence | 422/26 |
| 4,998,425 | A | * | 3/1991 | Hoogland | 70/159 |
| 5,139,186 | A | * | 8/1992 | Loew et al. | 224/42.39 |
| 5,823,349 | A | * | 10/1998 | Bridges | 206/597 |
| 6,113,268 | A | | 9/2000 | Thompson | 383/40 |
| 6,401,889 | B1 | | 6/2002 | McCleskey | 190/102 |

* cited by examiner

*Primary Examiner*—Anthony D. Stashick
*Assistant Examiner*—Harry A. Grosso
(74) *Attorney, Agent, or Firm*—McAndrews, Held & Malloy, Ltd.

(57) ABSTRACT

An apparatus including an open box structure having a top, a first side, a second side, a third side, and a fourth side, an inner chamber bound by the top, first, second, third, and fourth sides, and an opening leading to the inner chamber, is disclosed. The first side may be opposite the second side. The apparatus may include a first strap having a first end attached to the first side of the open box structure and a second end. The first strap may be of sufficient length so that the second end of the first strap can be pulled across the opening of the open box structure and attached to the second side of the open box structure, when the open box structure is fully extended. The first strap and/or a second similar strap may be used to secure the open box structure and freight within the open box structure to a pallet.

5 Claims, 6 Drawing Sheets

FREIGHT ENCLOSURE

CROSS REFERENCE TO RELATE APPLICATIONS

The present application claims the priority of and is a continuation in part of U.S. patent application Ser. No. 09/568,113, filed on May 10, 2000 now abandoned, Ser. No. 10/112,233, filed on Mar. 28, 2002 now U.S. Pat. No. 6,907,712, Ser. No. 10/266,347, filed on Oct. 8, 2002 now U.S. Pat. No. 6,982,643, Ser. No. 10/300,518, filed on Nov. 20, 2002 now abandoned, and Ser. No. 10/385,994, filed on Mar. 11, 2003 now abandoned, at least one of the one or more inventors or applicants was Jeffrey Garfinkle.

FIELD OF THE INVENTION

This invention relates to improved methods and apparatus concerning protecting freight from damage.

BACKGROUND OF THE INVENTION

Typically in the prior art freight is protected by sheets of plastic which are easy to cut and/or tamper with, without detection. Such sheets of plastic are also not particularly durable.

SUMMARY OF THE INVENTION

The present invention in one or more embodiments provides an apparatus comprising an open box structure having a top, a first side, a second side, a third side, and a fourth side, an inner chamber bound by the top, first, second, third, and fourth sides, and an opening leading to the inner chamber. The first side may be opposite the second side. The third side may be opposite the fourth side. The first and second sides may be substantially parallel. The third and fourth sides may be substantially parallel. The first side may be substantially perpendicular to the third and fourth sides.

The apparatus may include a first strap having a first end attached to the first side of the open box structure and a second end. The first strap may be of sufficient length so that the second end of the first strap can be pulled across the opening of the open box structure and attached to the second side of the open box structure, when the open box structure is fully extended. The first strap may have a first opening near the second end of the first strap; and the second side of the open box structure may have a second opening. A first attachment device can be inserted into the first opening of the first strap and into the second opening of the second side in order to attach the first strap to the second side of the open box structure. The first attachment device may include a loop of a lock. The apparatus may include a second strap similar to the first strap and a second attachment device similar to the first attachment device.

In one or more embodiments a method is also provided including placing an open box structure over freight which sits on a pallet. The method may further include attaching a second end of a first strap to a second side of the open box structure. The method may also include attaching a second end of a second strap to a second side of the open box structure. The second ends of the first and/or second straps may be locked to the second side of the open box structure. The second ends of the first and second straps may be attached in such a way that the freight lies inside a cavity of the open box structure and the open box structure and the freight are secured to the pallet.

DETAILED DESCRIPTION OF THE DRAWINGS

Figure 1:
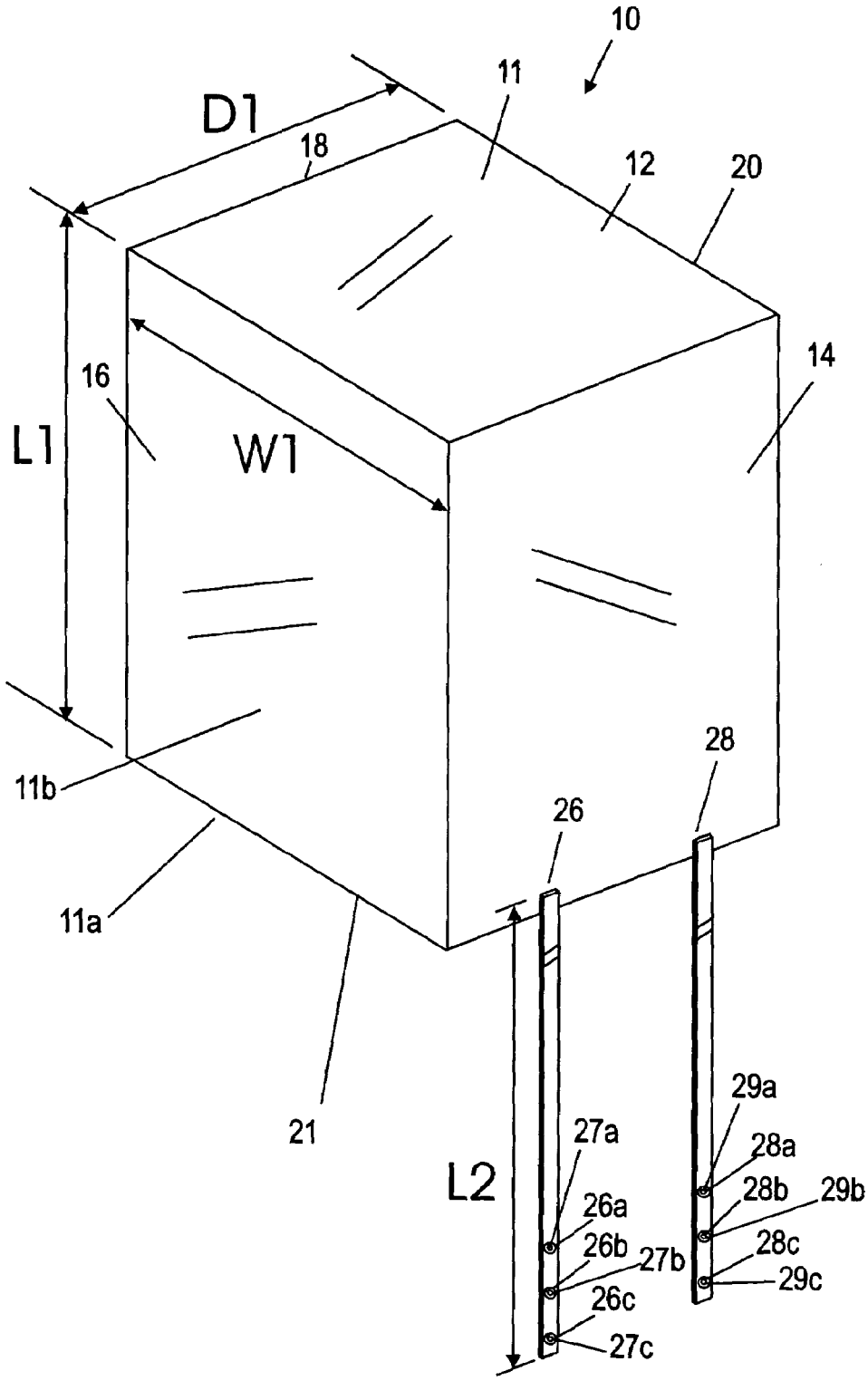
FIG. 1 shows a perspective view of an apparatus in accordance with a first embodiment of the present invention.
Figure 2:
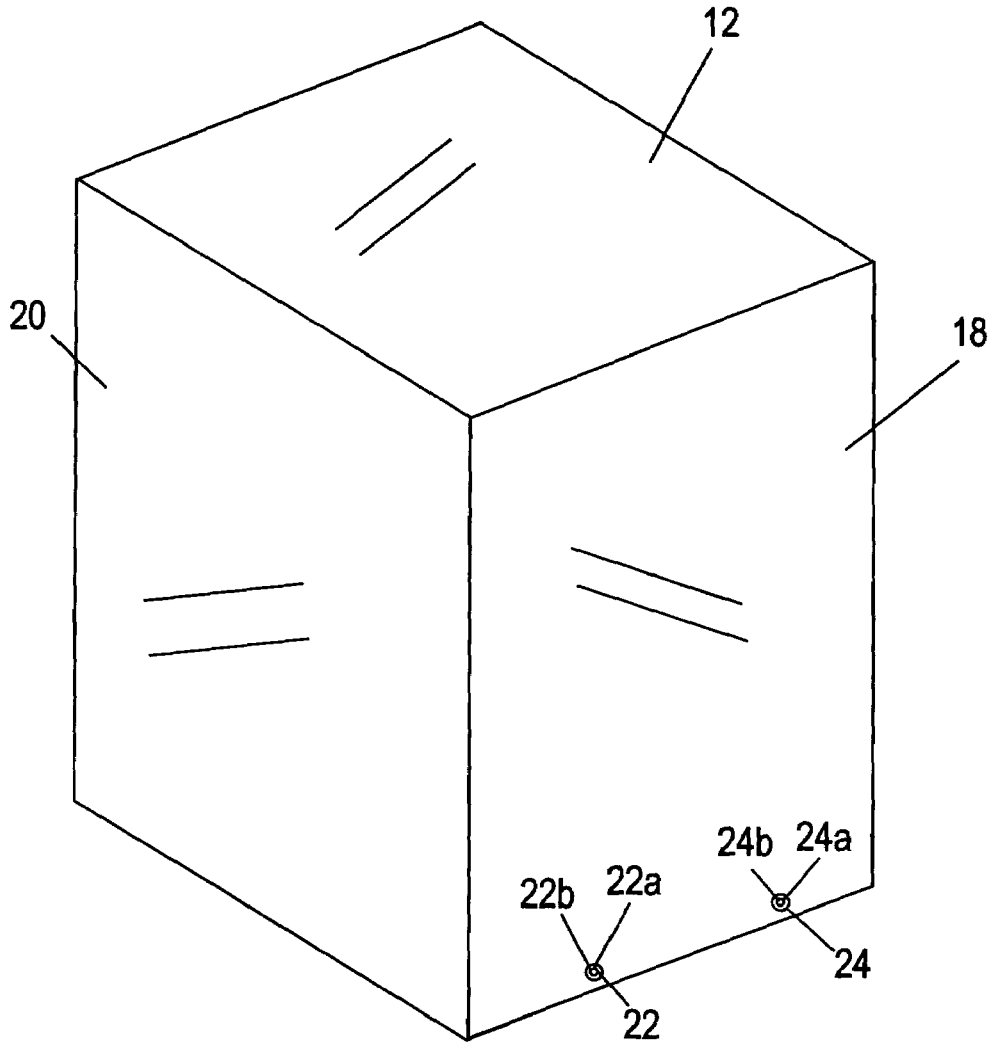
FIG. 2 shows another perspective view of the apparatus of FIG. 1.

FIG. 1 shows a perspective view of an apparatus 10 in accordance with a first embodiment of the present invention. FIG. 2 shows another perspective view of the apparatus 10 of FIG. 1. The apparatus 10 includes a top 12, sides 14, 16, 18, and 20. The apparatus 10 also includes straps 26 and 28. The straps 26 and 28 are attached to side 14. The strap 26 has metal rings 26*a*, 26*b*, and 26*c*, which have openings 27*a*, 27*b*, and 27*c*, respectively. The strap 28 has metal rings 28*a*, 28*b*, and 28*c*, which have openings 29*a*, 29*b*, and 29*c*, respectively.

Figure 3:
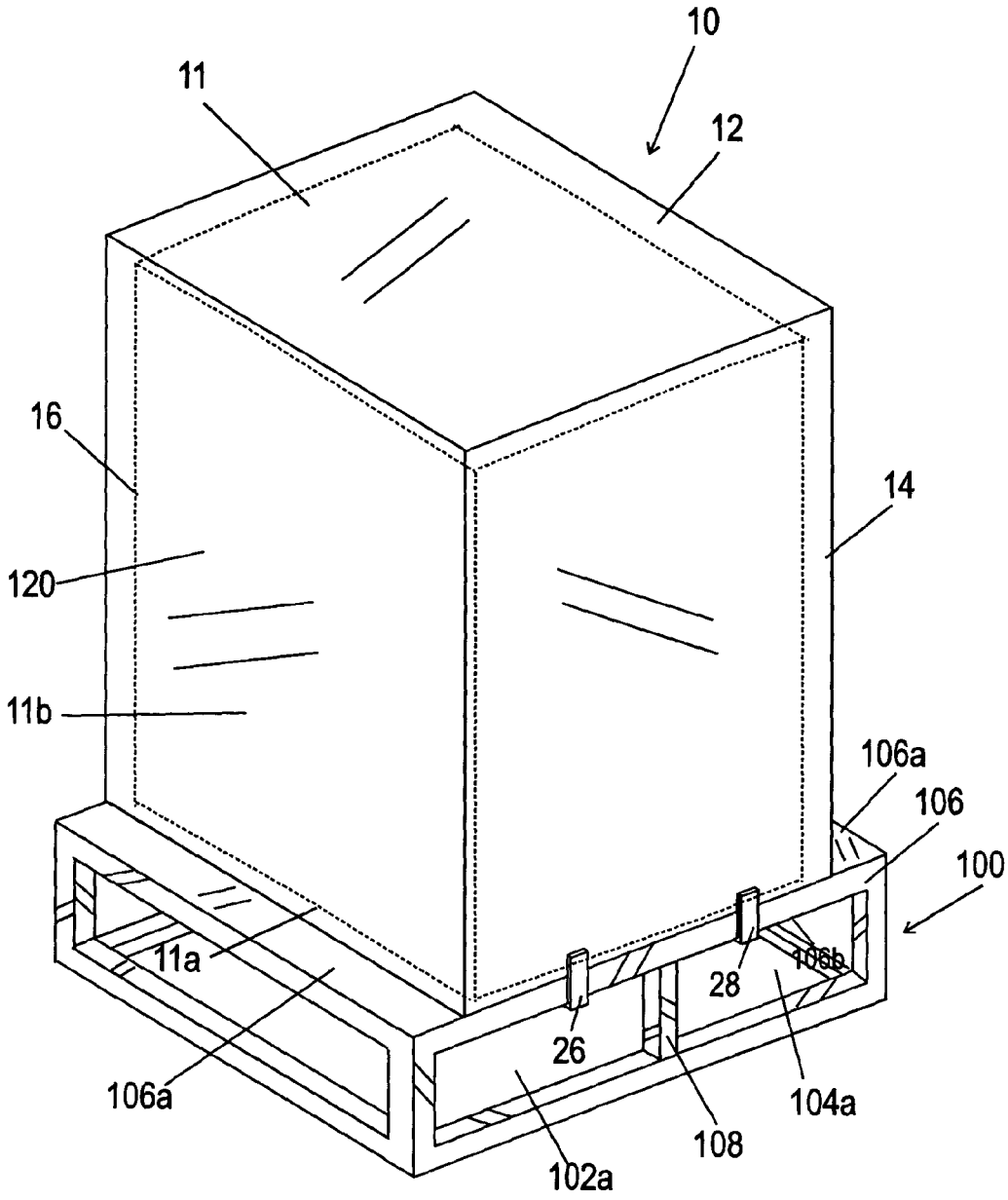
FIG. 3 shows a perspective view of the apparatus of FIG. 1 on a pallet with straps pulled under a portion of the pallet.
Figure 4:
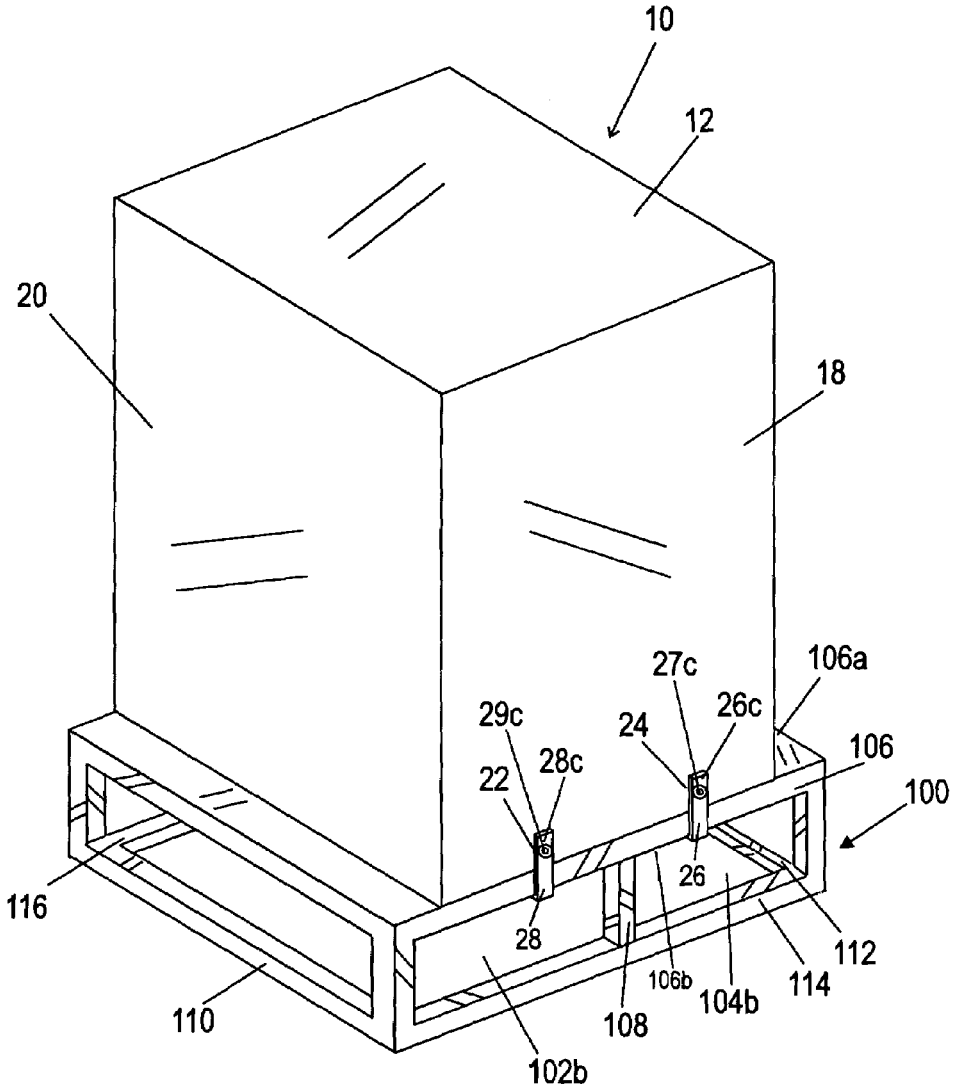
FIG. 4 shows another perspective view of the apparatus of FIG. 1 on a pallet with straps pulled under a portion of the pallet.
Figure 5:
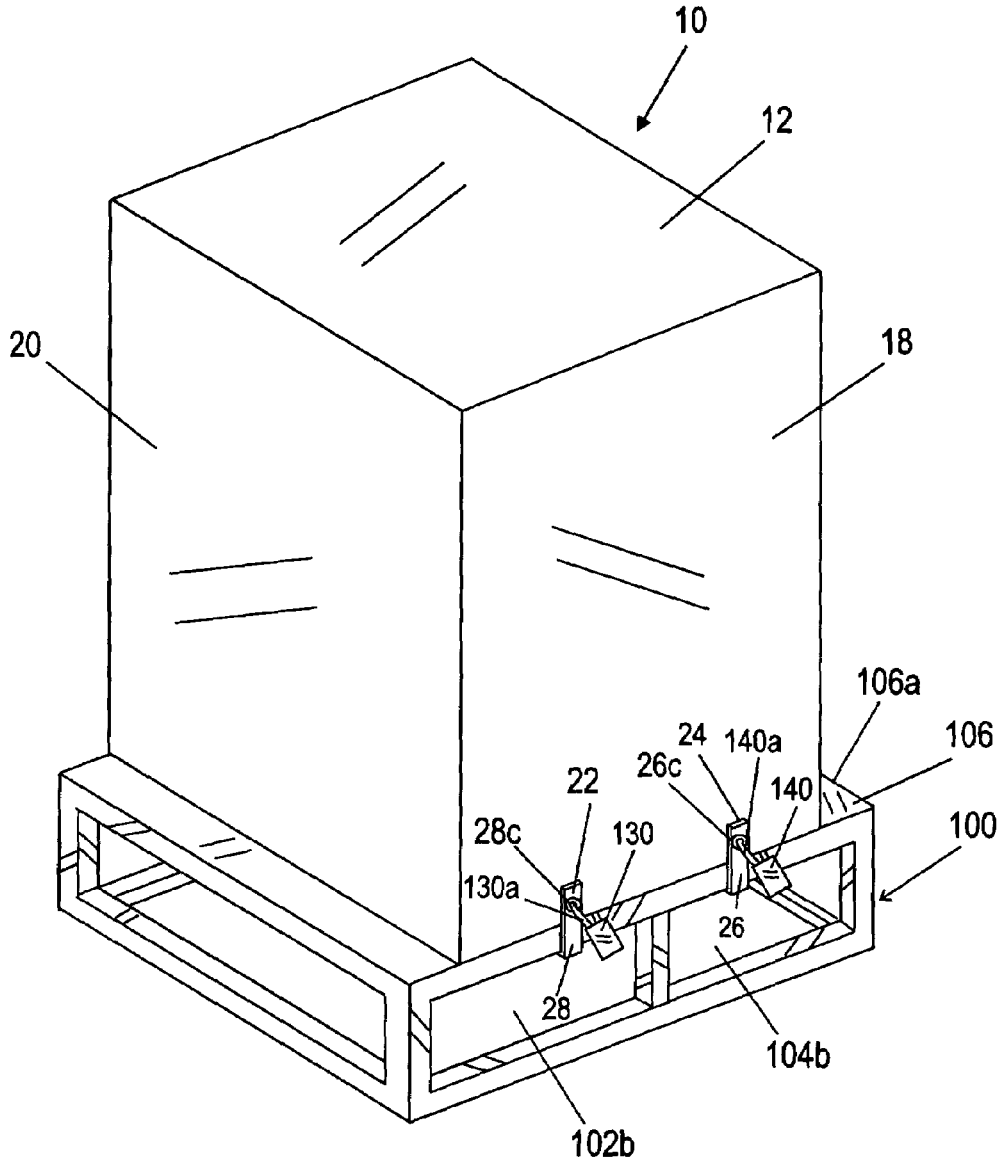
FIG. 5 shows a perspective view of the apparatus of FIG. 1 on a pallet with straps pulled under the pallet securing the apparatus to the pallet and with locks or seals securing the straps.
Figure 6:
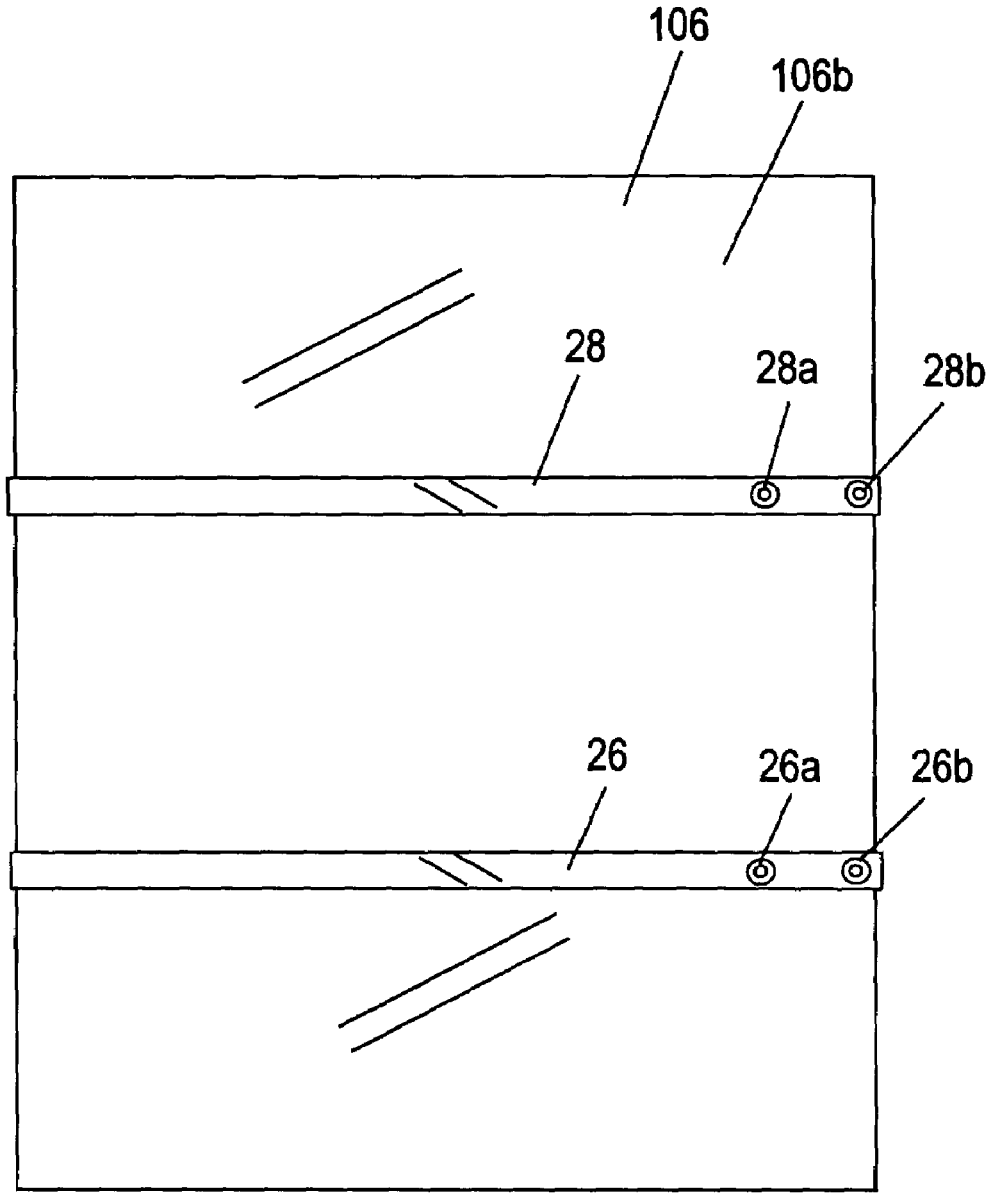
FIG. 6 shows an underside view of the straps holding the apparatus to the pallet.

The top 12 and sides 14, 16, 18, and 20 form a box shape having an opening 21. FIG. 3 shows a perspective view of the apparatus 10 of FIG. 1 placed over freight 120 (shown by dashed lines) on a pallet 100 with straps 26 and 28 pulled under a portion 106 of the pallet 100. FIG. 4 shows another perspective view of the apparatus 10 of FIG. 1 placed over freight 120 on the pallet 100 with the straps 26 and 28 pulled under the portion 106 of the pallet 100. FIG. 5 shows a perspective view of the apparatus 10 of FIG. 1 on the pallet 100 with the strap 26 and 28 pulled under the portion 106 of the pallet 100 securing the apparatus 10 to the pallet 100 and with locks or seals 130 and 140 securing the straps 26 and 28. FIG. 6 shows an underside view of the straps 26 and 28 holding the apparatus 10 to the pallet 100.

The pallet 100 shown in FIGS. 3–6 includes top board or portion 106 having a top surface 106*a*, openings 102*a* and 104*a* (shown in FIG. 3), openings 102*b* and 104*b* (shown in FIG. 4), and members 108, 110, 112, 114, and 116.

In operation an individual places the open box structure 11 of the apparatus 10 over freight 120 until the bottom edge 11*a* of the box structure 11 contacts the top surface 106*a* of the portion 106 of the pallet 110, as shown by FIG. 3. The freight 120, will at this point be inside the cavity or chamber 11*b* of the open box structure 11, as shown by FIG. 3. Next ends 26*d* and 28*d* of the straps 26 and 28 respectively, shown in FIG. 1, are inserted through the openings 102*a* and 104*a* of the pallet 100 shown in FIG. 3. The ends 26*d* and 28*d* are then pulled underneath the bottom surface 106*b* of the portion 106 of the pallet 100, and out through the openings 102*b* and 104*b*, as by FIGS. 4 and 6. Strap 28 is then secured to the side 18 of the box structure 11 by inserting ring or loop 130*a* of lock 130 through opening 29*c* of ring 28*c* in the strap 28, and by locking the lock or seal 130. Similarly, strap 26 is secured to the side 18 of the box structure 11 by inserting ring or loop 140*a* of lock 140 through opening 27*c* of ring 26*c* in the strap 26, and by locking the lock or seal

140. With the lock or seals 130 and 140 locked, the straps 26 and 28 secure the box structure 11 to the portion 106 of the pallet 100.

Referring to FIG. 1, the open box structure 11 may have a width, W1, which may be about forty-five inches, and a depth, D1, which may be about forty-five inches. The structure 11 may have a length L1 which may be about sixty inches. The straps 26 and 28 may have each have a length L2, which may be about fifty-once inches. The length of the straps 26 and 28 should be greater than the side 16 or 20 so that the straps 26 and 28 can be brought across the opening 21 of the box structure 11 and attached to side 18. The straps 26 and 28 may each be about one and one half inches in width. There may be a distance of about two and one half inches between adjacent rings of rings 26*a*, 26*b*, and 26*c*, and rings 28*a*, 28*b*, and 28*c*. The rings 26*a*–26*c* and 28*a*–*c* may be metal. The straps 26 and 28 may be a fabric. The box structure may be made of Tyvek (trademarked) or some other durable, strong, lightweight,and waterproof material.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A flexible freight cover for covering and securing freight placed on a pallet, the cover comprising:

a top portion and first, second, third and fourth sidewalls made from a flexible, water proof material, the first, second, third and fourth sidewalls being joined at their upper ends to the top portion and joined at their respective sides to an adjacent sidewall so that the top portion and sidewalls together form a box-shaped structure with an open bottom which is sized to fit over and cover the freight on the pallet; and at least one elongate flexible strap having a first end attached to the first sidewall and a second end adapted to be fastened to the second sidewall opposite the first sidewall, the strap having a length sufficient to permit the strap to be engaged with the pallet and pulled across the open bottom of the cover and then fastened to the second sidewall to secure the freight to the pallet, the second end of the elongate strap having at least one ringed opening therethrough, and the second sidewall having an opening therethrough, and wherein the cover further includes an attachment device having a ring, with the ring being inserted into the ringed opening in the second end of the elongate strap and into the opening in the second sidewall and locked to fasten the second end of the elongate strap to the second sidewall.

2. The flexible freight cover according to claim 1, wherein the second end of the elongate strap has a plurality of spaced apart ringed openings therethrough, and the ring of the attachment device can be inserted into one of the plurality of spaced apart openings and into the opening in the second sidewall to secure the freight to the pallet.

3. The flexible freight cover according to claim 1 wherein the cover is provided with a second elongate strap having a first end attached to the first sidewall and spaced apart from the first elongate strap, the second elongate strap having a second end adapted to be fastened to the second sidewall, the second elongate strap having a length sufficient to permit the strap to be engaged with the pallet and pulled across the open bottom of the cover and then fastened to the second sidewall to secure the freight to the pallet.

4. The flexible freight cover according to claim 3 wherein the second end of the second elongate strap has at least one ringed opening therethrough, and the second sidewall has a second opening therethrough, and wherein the cover further includes a second attachment device having a ring that is inserted into the ringed opening in the second end of the second elongate strap and into the second opening in the second sidewall and locked to fasten the second end of the second strap to the second sidewall.

5. The flexible freight cover according to claim 4, wherein the second end of the second elongate strap has a plurality of spaced apart ringed openings therethrough, and the ring of the second attachment device can be inserted into one of the plurality of spaced apart ringed openings in the second end of the second elongate strap and into the second opening in the second sidewall to secure the freight to the pallet.

* * * * *